US009532699B2

(12) United States Patent
Feddema

(10) Patent No.: US 9,532,699 B2
(45) Date of Patent: Jan. 3, 2017

(54) DISHWASHER WITH SPRAYER

(71) Applicant: Whirlpool Corporation, Benton Harbor, MI (US)

(72) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 722 days.

(21) Appl. No.: 13/941,898

(22) Filed: Jul. 15, 2013

(65) Prior Publication Data

US 2015/0013729 A1 Jan. 15, 2015

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01); *A47L 15/4289* (2013.01)

(58) Field of Classification Search
CPC .. A47L 15/23; A47L 15/4282; A47L 15/4221; A47L 15/4289; A47L 15/22
USPC . 134/176, 179, 56 D, 198, 172, 57 D, 58 D, 134/180, 178, 144, 181; 239/251, 245, 239/261, 222.17, 227, 237, 240, 242, 243, 239/380, 381
See application file for complete search history.

(56) References Cited

U.S. PATENT DOCUMENTS

| | | | |
|---|---|---|---|
| 3,064,664 | A | 11/1962 | Warhus |
| 3,064,665 | A | 11/1962 | Martiniak |
| 3,146,953 | A | 9/1964 | Komanns |
| 3,253,784 | A | 5/1966 | Long et al. |
| 3,709,236 | A | 1/1973 | Field et al. |
| 3,771,725 | A | 11/1973 | Jenkins et al. |
| 3,797,509 | A | 3/1974 | Fukuzawa et al. |
| 3,918,644 | A | 11/1975 | Platt et al. |
| 4,266,565 | A | 5/1981 | Gurubatham |
| 4,509,687 | A | 4/1985 | Cushing |
| 4,993,444 | A | 2/1991 | Toriyama et al. |
| 5,331,986 | A | 7/1994 | Lim et al. |
| 5,415,350 | A | 5/1995 | Yoon et al. |
| 5,427,129 | A | 6/1995 | Young, Jr. et al. |
| 2,726,666 | A | 12/1995 | Oxford |
| 5,546,968 | A | 8/1996 | Jeon et al. |
| 5,577,665 | A | 11/1996 | Chang |
| 5,601,100 | A | 2/1997 | Kawakami et al. |
| 5,609,174 | A | 3/1997 | Ferguson |
| 5,655,556 | A | 8/1997 | Guerrera et al. |
| 5,662,744 | A | 9/1997 | Tuller et al. |

(Continued)

FOREIGN PATENT DOCUMENTS

| | | |
|---|---|---|
| DE | 7024995 U | 6/1970 |
| DE | 4036930 A1 | 5/1992 |

(Continued)

OTHER PUBLICATIONS

European Search Report for Corresponding EP14155441.0, May 30, 2014.

(Continued)

*Primary Examiner* — David Cormier
*Assistant Examiner* — Thomas Bucci

(57) ABSTRACT

A dishwasher includes a tub at least partially defining a treating chamber and a spraying system having a sprayer supplying liquid to the treating chamber. The sprayer may include a liquid passage and multiple spray outlets to emit sprays to wash the dishes, a first valve body to couple at least one of the multiple spray outlets to the liquid passage, and a second valve body to control a flow of liquid.

18 Claims, 9 Drawing Sheets

(56) References Cited

U.S. PATENT DOCUMENTS

| | | | | |
|---|---|---|---|---|
| 5,673,714 | A | 10/1997 | Campagnolo et al. | |
| 5,697,392 | A | 12/1997 | Johnson et al. | |
| 5,944,037 | A | 8/1999 | Sinyong et al. | |
| 5,964,232 | A | 10/1999 | Chung | |
| 6,053,185 | A | 4/2000 | Beevers | |
| 6,325,083 | B1 | 12/2001 | Worter | |
| 7,314,188 | B2 | 1/2008 | Watson et al. | |
| 7,331,356 | B2 | 2/2008 | VanderRoest et al. | |
| 7,445,013 | B2 | 11/2008 | VanderRoest et al. | |
| 7,475,696 | B2 | 1/2009 | Vanderroest et al. | |
| 7,493,907 | B2 | 2/2009 | Roh | |
| 7,523,758 | B2 | 4/2009 | Vanderroest et al. | |
| 7,594,513 | B2 | 9/2009 | VanderRoest et al. | |
| 7,673,639 | B2 | 3/2010 | Shin | |
| 7,810,512 | B2 | 10/2010 | Pyo et al. | |
| 7,896,977 | B2 | 3/2011 | Gillum et al. | |
| 7,935,194 | B2 | 5/2011 | Rolek | |
| 7,959,744 | B2 | 6/2011 | Sundaram et al. | |
| 7,980,260 | B2 | 7/2011 | Bertsch et al. | |
| 8,113,222 | B2 | 2/2012 | Bertsch et al. | |
| 8,137,479 | B2 | 3/2012 | Vanderroest et al. | |
| 8,187,390 | B2 | 5/2012 | Vanderroest et al. | |
| 8,210,191 | B2 | 7/2012 | Gnadinger et al. | |
| 8,282,741 | B2 | 10/2012 | Bertsch et al. | |
| 2006/0108454 | A1 | 5/2006 | Eichholz | |
| 2006/0278258 | A1* | 12/2006 | Kara | A47L 15/23 134/56 D |
| 2007/0056613 | A1 | 3/2007 | Haas et al. | |
| 2007/0289615 | A1 | 12/2007 | Shin | |
| 2009/0101182 | A1 | 4/2009 | Buesing et al. | |
| 2009/0101185 | A1 | 4/2009 | Pardini | |
| 2009/0159103 | A1 | 6/2009 | Gillum et al. | |
| 2010/0108102 | A1 | 5/2010 | Kehl et al. | |
| 2010/0139719 | A1 | 6/2010 | Gnadinger et al. | |
| 2011/0030742 | A1 | 2/2011 | Dalsing et al. | |
| 2011/0203619 | A1 | 8/2011 | Kara et al. | |
| 2011/0303250 | A1 | 12/2011 | Delgado et al. | |
| 2012/0279530 | A1 | 11/2012 | Thiyagarajan | |
| 2012/0279536 | A1 | 11/2012 | Adams et al. | |
| 2013/0074886 | A1 | 3/2013 | Feddema et al. | |
| 2013/0074888 | A1 | 3/2013 | Feddema | |
| 2013/0074890 | A1 | 3/2013 | Feddema et al. | |
| 2014/0054395 | A1 | 2/2014 | Heisele et al. | |
| 2014/0332041 | A1 | 11/2014 | Feddema | |

FOREIGN PATENT DOCUMENTS

| | | | | |
|---|---|---|---|---|
| DE | 102005026558 | B3 | 11/2006 | |
| DE | 102010043019 | A1 | 5/2012 | |
| DE | 102011053666 | A1 | 5/2012 | |
| EP | 0524102 | A1 | 1/1993 | |
| EP | 0764421 | A1 | 3/1997 | |
| EP | 0795292 | A2 | 9/1997 | |
| EP | 0943281 | A2 | 9/1999 | |
| EP | 0943282 | A2 | 9/1999 | |
| EP | 1040786 | A1 | 10/2000 | |
| EP | 1040787 | A1 | 10/2000 | |
| EP | 1252856 | A2 | 10/2002 | |
| EP | 1277430 | A1 | 1/2003 | |
| EP | 1334687 | A1 | 8/2003 | |
| EP | 2292134 | A1 | 3/2011 | |
| EP | 2572624 | A1 | 3/2013 | |
| GB | 2019204 | A | 10/1979 | |
| GB | 2199734 | A | 7/1988 | |
| GB | 2215990 | A | 10/1989 | |
| JP | 60053120 | | 3/1985 | |
| JP | 4033632 | A | 2/1992 | |
| JP | 5184514 | A | 7/1993 | |
| JP | 8089467 | A | 4/1996 | |
| JP | 9164107 | A | 6/1997 | |
| JP | 10243910 | A | 9/1998 | |
| JP | 11019019 | A | 1/1999 | |
| JP | 11076127 | A | 3/1999 | |
| JP | 2004113683 | A | 4/2004 | |
| KR | 200156558 | Y1 | 9/1999 | |
| KR | 20060029567 | A | 4/2006 | |
| KR | 20090037299 | A | 4/2009 | |
| SE | WO 2011154471 | A1 * | 12/2011 | A47L 15/23 |
| WO | 2010012703 | A2 | 2/2010 | |
| WO | 2011144540 | A2 | 11/2011 | |
| WO | 2011154471 | A1 | 12/2011 | |
| WO | 2012065873 | A2 | 5/2012 | |

OTHER PUBLICATIONS

European Search Report for Corresponding EP14155444.4, May 6, 2014.

European Search Report for Corresponding EP 12185510.0, Dec. 19, 2012.

European Search Report for Corresponding EP 12185514.2, Dec. 6, 2012.

European Search Report for Corresponding EP 12185512.6, Dec. 6, 2012.

German Search Report for Counterpart DE102013111241.2, May 23, 2014.

European Search Report for Corresponding EP14177086.7, Oct. 20, 2014.

* cited by examiner

DISHWASHER WITH SPRAYER

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The spraying system may include various sprayers including a rotatable sprayer.

SUMMARY

An embodiment of the invention relates to a dishwasher for washing dishes according to an automatic cycle of operation, having a tub at least partially defining a treating chamber for receiving dishes for cleaning and a spraying system supplying liquid to the treating chamber and having a sprayer with a sprayer body mounted within the tub for movement about a rotatable axis and having an interior, a liquid passage provided in the interior, multiple spray outlets extending through the body and in fluid communication with the liquid passage and configured to emit sprays of liquid into the treating chamber to wash the dishes, a first valve body moveable relative to the body and having at least one opening to fluidly couple at least one of the multiple spray outlets to the liquid passage, and a second valve body selectively moveable relative to at least one of the sprayer body or the first valve body to control a flow of liquid through the at least one opening or through at least one of the multiple spray outlets.

DESCRIPTION OF EMBODIMENTS OF THE INVENTION

Figure 1:
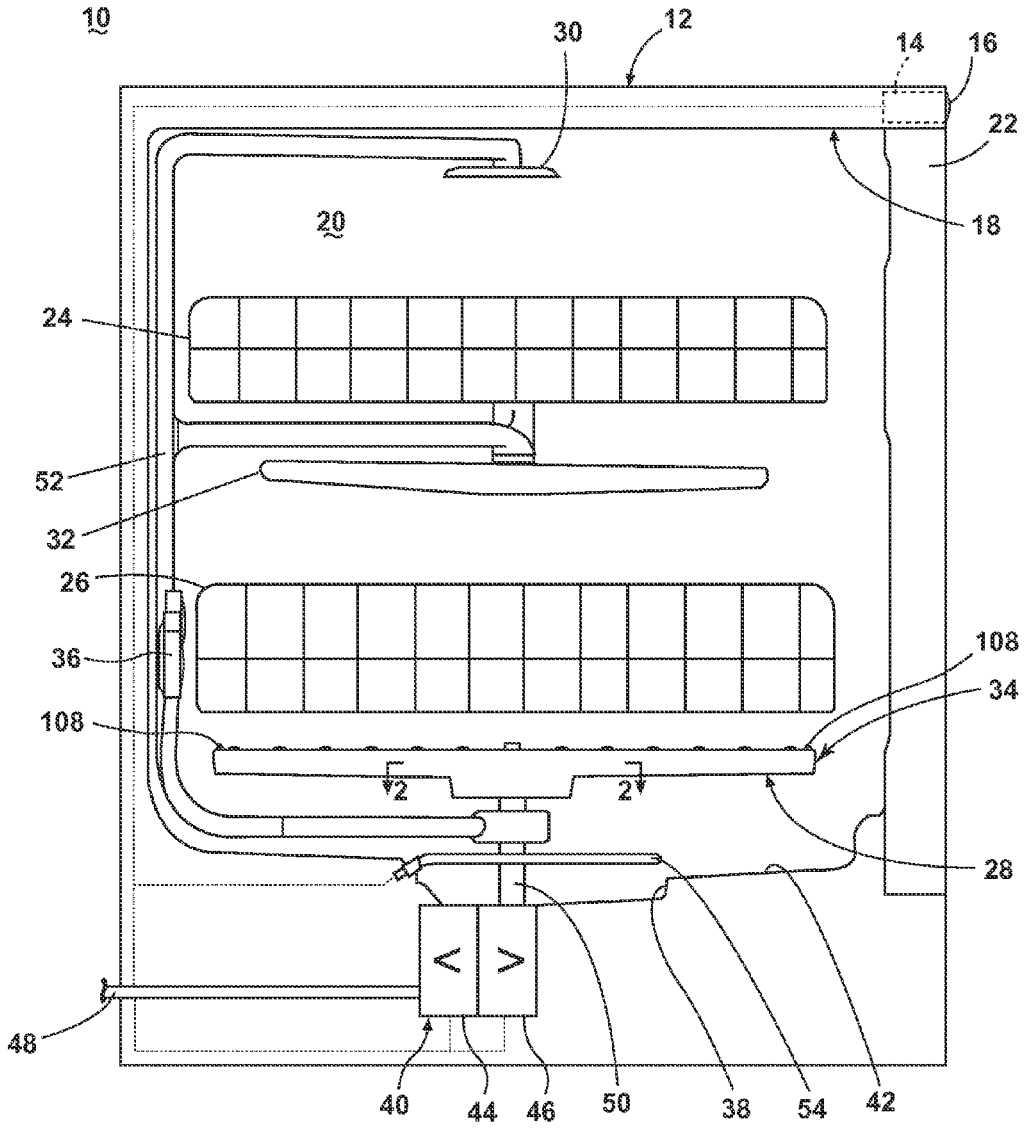
FIG. 1 is a schematic view of a dishwasher with a spray system according an embodiment of the invention.

Referring to FIG. 1, an automatic dishwasher 10 having a cabinet 12 defining an interior is illustrated. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional dish holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44 and 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
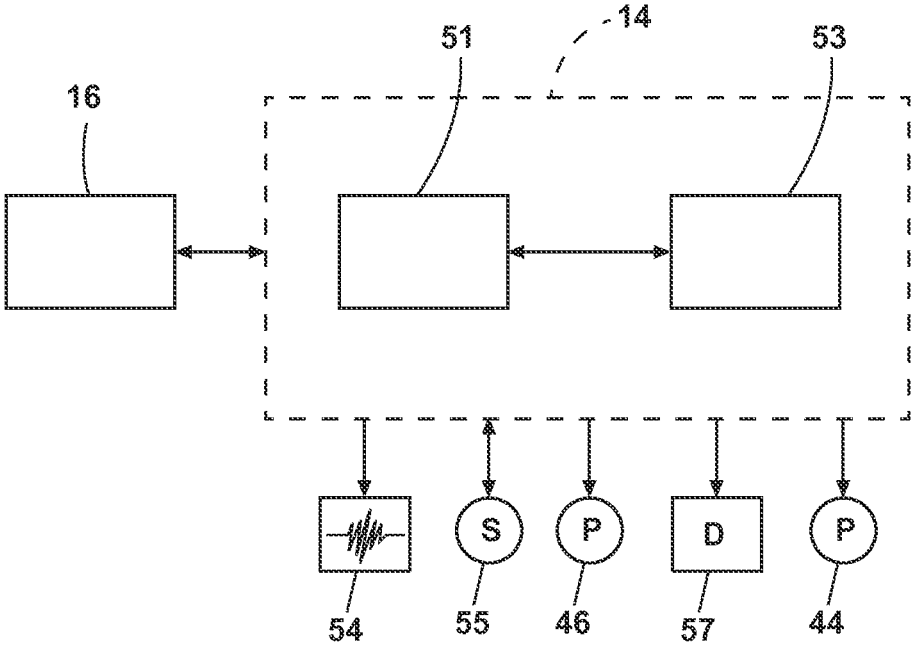
FIG. 2 is a schematic view of a control system of the dishwasher of FIG. 1.

As illustrated in FIG. 2, the controller 14 may be provided with a memory 51 and a central processing unit (CPU) 53. The memory 51 may be used for storing control software that may be executed by the CPU 53 in completing a cycle of operation using the dishwasher 10 and any additional software. For example, the memory 51 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 55. Non-limiting examples of optional sensors 55 that may be communicably coupled with the controller 14 include a moisture sensor, a door sensor, a temperature sensor, a detergent and rinse aid presence/type sensor(s). The controller 14 may also be coupled to a dispenser 57, which may dispense a detergent during the wash step of the cycle of operation or a rinse aid during the rinse step of the cycle of operation.

Figure 3A:
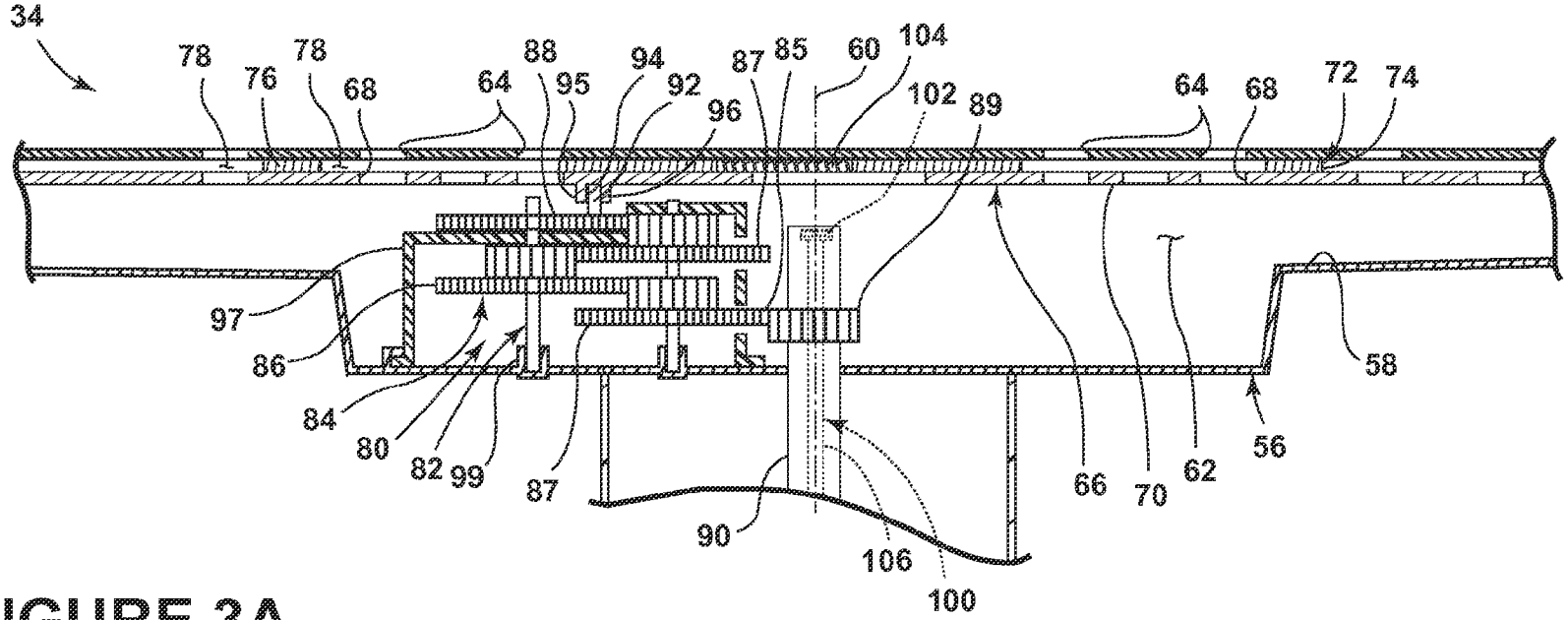
FIGS. 3A-3C are cross-sectional views of a rotatable spray arm according to an embodiment of the invention that may be used in the spray system of the dishwasher of FIG. 1 and illustrating a first valve body and a second valve body for the rotatable spray arm in various positions.

FIG. 3A illustrates a cross-sectional view of the lower rotatable spray arm 34 comprising a sprayer body 56 having an interior 58 and mounted within the tub 18 for movement about a rotatable axis 60. A liquid passage 62 may be provided in the interior 58 and fluidly couples with the outlet conduit 50 and recirculation pump 46. As illustrated, the interior 58 defines the liquid passage 62. However, a separate liquid passage 62 may be located within the interior 58.

Multiple spray outlets 64 extend through the sprayer body 56 and may be in fluid communication with the liquid passage 62. The multiple spray outlets 64 may be configured to emit sprays of liquid into the treating chamber 20 to wash the dishes therein. The multiple spray outlets 64 may be located and spaced in any suitable manner.

A first valve body 66 is illustrated as being located within the interior of the sprayer body 56 and may be moveable relative to the sprayer body 56 to selectively fluidly couple at least one of the multiple spray outlets 64 to the liquid passage 62. More specifically, the first valve body 66 may have at least one opening 68, which may fluidly couple at least one of the multiple spray outlets 64 to the liquid passage 62. The first valve body 66 has been illustrated as including a first slidable element 70 having multiple openings 68, which may align with some of the multiple spray outlets 64 such that the some of the multiple spray outlets 64 may be fluidly coupled to the liquid passage 62. The first slidable element may be slidably mounted within the interior of the sprayer body 56 of the rotatable spray arm 34 for movement therein to selectively fluidly couple at least some of the multiple spray outlets 64 to the liquid passage 62. In this manner, the first valve body 66 may form a portion of the liquid passage 62 leading to the fluidly coupled multiple spray outlets 64. The first valve body 66 may be reciprocally moveable within the sprayer body 56.

A second valve body 72 is also illustrated as being located within the interior of the sprayer body 56 and may be moveable relative to at least one of the sprayer body 56 or the first valve body 66 to control a flow of liquid through the at least one opening 68 or through at least one of the multiple spray outlets 64. More specifically, the second valve body 72 has been illustrated as including a second slidable element 74 that has solid portions 76 which may block the fluid coupling between at least one of the multiple spray outlets 64 and the liquid passage 62. Open portions 78 are also formed in the second slidable element 74 to allow at least one of the multiple spray outlets 64 to fluidly couple with the liquid passage 62. The first slidable element may be slidably mounted within the interior of the sprayer body 56 of the rotatable spray arm 34 for movement therein to control a flow of liquid through the at least one opening 68 or through at least one of the multiple spray outlets 64. The second valve body 72 may also be reciprocally moveable within the sprayer body 56.

The first slidable element 70 and the second slidable element 74 may be formed in any suitable manner and may or may not be similarly formed. For example, the first slidable element 70 and the second slidable element 74 may include a rigid plate, a flexible plate, or a thin film plate, which may be either flexible or rigid. For example, the first slidable element 70 may include a first membrane with the openings 68 formed therein and the second slidable element 74 may include a second membrane with solid portions 76 and open portions 78. The second slidable element 74 may abut portions of an upper surface of the sprayer body 56, the first slidable element 70 may also abut portions of the upper surface of the sprayer body 56 and may be adjacent the second slidable element 74. The first slidable element 70 and second slidable element 74 may conform to the shape of the sprayer and may form a liquid seal between the portions of the sprayer body 56 and the liquid passage 62.

In the illustrated example, the first slidable element 70 and the second slidable element 74 are illustrated as not being operably coupled. This need not be the case and the first and second slidable elements 70 and 74 may be operably coupled. In the illustrated example, an actuator 80 may be operably coupled with the first valve body 66 and may move the first valve body 66 based on the rotation of the lower rotatable spray arm 34. The actuator 80 may be any suitable mechanism capable of moving the first valve body 66 based on the rotation of the lower rotatable spray arm 34. By way of a non-limiting example, the actuator 80 may include a drive system 82 operably coupled with the lower rotatable spray arm 34 and the first valve body 66 such that rotation of the lower rotatable spray arm 34 moves the first valve body 66. The drive system 82 has been illustrated as including a gear assembly 84 operably coupling the lower rotatable spray arm 34 and the first valve body 66 such that rotation of the lower rotatable spray arm 34 moves the gear assembly 84 which in turn moves the first slidable element 70 and the second slidable element 74. Thus, the gear assembly 84 helps convert the rotational motion of the lower rotatable spray arm 34 into sliding motion for the first slidable element 70 and the second slidable element 74. The gear assembly 84 has been illustrated as including a gear chain having a first gear 85, second gear 86, third gear 87, fourth gear 88, and a fixed gear 89. A fixed shaft 90 may extend through a portion of the sprayer body 56 such that the lower rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the first valve body 66 to operably couple the gear assembly 84 with the first slidable element 70. The channel 94 may be a depression in a bottom portion of the first slidable element 70 or as illustrated may be formed between two opposing walls 95, 96 extending downwardly from the bottom of the first slidable element 70. A bracket 97 may be located within the interior 62 and houses at least a portion of the gear assembly 84 to provide support for the gear assembly 84. Portions of the gear assembly 84 may also be held within supports 98 formed by the sprayer body 56 of the lower rotatable spray arm assembly 34.

An actuator 100 may be operably coupled with the second valve body 72 and may move the second valve body 72 regardless of the movement of the lower rotatable spray arm 34. In this manner, the first valve body 66 and the second valve body 72 need not move in tandem. By way of a non-limiting example, the actuator 100 may include a gear 102, which may be selectively operably coupled to teeth 104 formed in the second valve body 72 such that rotation of the gear 102 moves the second slidable element 74. The gear 102 may be operably coupled to a translatable shaft 106. When not in use, as shown, the gear 102 and the translatable shaft 106 may be housed within the fixed shaft 90. The translatable shaft 106 may be moved upwards and downwards so that the gear may selectively mate with the teeth 104. Furthermore, the translatable shaft 106 may be rotated such that the gear 102 may be rotated. It is contemplated that the translatable shaft may be operably coupled to any suitable mechanism to accomplish such movements. For example, the translatable shaft 106 may be operably coupled to a motor, solenoid, or other suitable driving mechanism. For example, a solenoid (not shown) may be operably coupled to the laterally extendable gear 102 through the translatable shaft 106 and the solenoid may raise, lower, and rotate the laterally extendable gear 102. Alternatively, it is contemplated that the second valve body 72 may be manually moveable between positions.

The operation of the dishwasher 10 with the described lower rotatable spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

The lower rotatable spray arm 34 may rely on liquid pumped from the recirculation pump 46 to provide hydraulic drive to rotate the lower rotatable spray arm 34, which through the actuator 80 affects the movement of the first valve body 66. More specifically, a hydraulic drive 108 (FIG. 1) may be formed by an outlet in the sprayer body 56 being oriented such that liquid emitted from the hydraulic drive outlet 108 effects the rotation of the lower rotatable spray arm 34. The lower rotatable spray arm 34 may have any number of hydraulic drive outlets 108 and these hydraulic drive outlets 108 may be located such that when the recirculation pump 46 is activated, the lower rotatable spray arm 34 rotates regardless of the position of the first valve body 66. It has also been contemplated that such hydraulic drive outlets 108 may be located on various portions of the sprayer body 56 including a side or bottom portion of the sprayer body 56.

As the lower rotatable spray arm 34 is hydraulically rotated about the fixed shaft 90, the first gear 85, which is mounted between the fixed gear 89 and the second gear 86, is rotatably mounted within the support 98, and moves with the rotation of the lower rotatable spray arm 34, may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88. As the fourth gear 88 rotates, the pin 92 rotates within the interior 62 of the lower rotatable spray arm 34. As the pin 92 rotates, it moves within the boundaries of the channel 94 and causes the first slidable element 70 to be moved back and forth within the interior 62 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88.

In this manner, the actuator 80 reciprocally moves the first valve body 66 within the sprayer body 56 based on the rotation of the sprayer body 56. As the first slidable element 70 moves back and forth, the second slidable element 74 moves with it in tandem. When the pin 92 pushes on the wall 95 it moves the first slidable element 70 to a first position, illustrated in FIG. 3A. In the first position, multiple openings 68 fluidly couple multiple spray outlets 64 to the liquid passage 62.

Figure 3B:
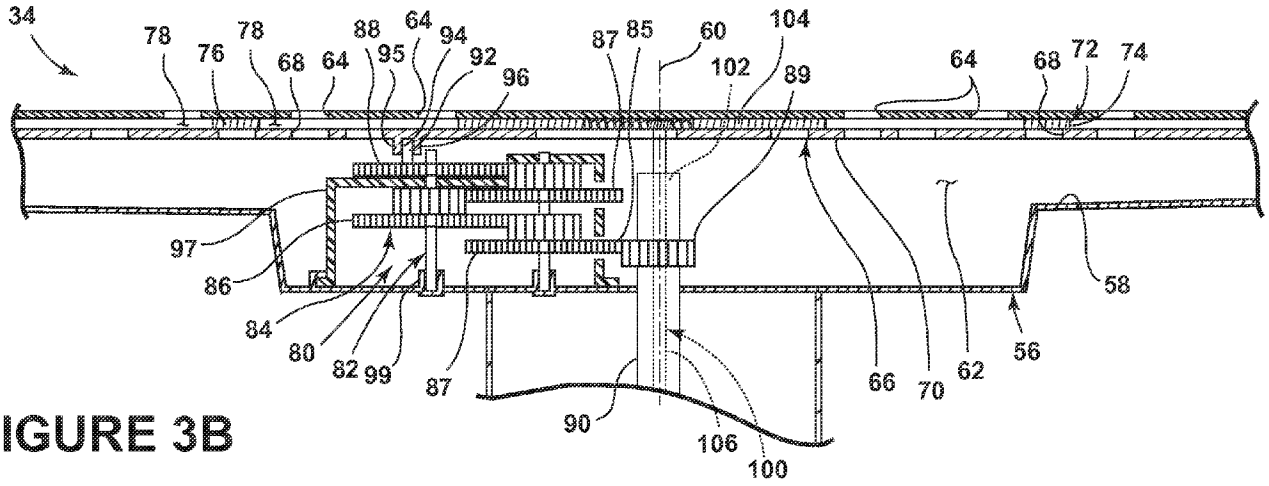

The first slidable element 70 may stay in the first position until the pin 92 is rotationally advanced to a point where it begins to push on the wall 96. When the pin 92 pushes on the wall 96 it moves the first slidable element 70 in the opposite direction until it reaches a second position, which is illustrated in FIG. 3B. In the second position, the first valve body 66 fluidly couples alternative spray outlets 64 to the liquid passage 62 as compared to when the first valve body 66 was in the first position. The first slidable element 70 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the first slidable element 70 into the first and second positions. In this manner, the actuator 80 allows the first valve body 66 to move between the at least two positions based on a rotational position of the lower rotatable spray arm 34. In this manner, the first valve body 66 is moveable between a first position in which at least some of the multiple spray outlets 64 are coupled to the liquid passage and a second position in which other of the multiple spray outlets 64 are coupled to the liquid passage.

As the first slidable element 70 moves side to side, the force and shape of the pattern of the sprays emitted from the spray outlets 64 may also change. As the openings 68 come into alignment with the spray outlets 64 the effective outlet or nozzle becomes wider, and a more diffused, wide-angle spray pattern may be emitted from the effective nozzle that produces a shower spray of liquid from the lower rotatable spray arm 34. Conversely, as the spray outlets 64 are overlapped with the first slidable element 70 the effective nozzle becomes smaller, and a more discrete, focused, and concentrated spray pattern may be emitted from the effective nozzle, which may provide a higher pressure spray from the lower rotatable spray arm 34. The shower spray may be more suitable for distributing treating chemistry whereas the higher pressure spray may be more suitable for dislodging soils. The different spray patterns, including the differing directions of spray, created may provide for different cleaning effects from the lower rotatable spray arm 34.

When the first valve body 66 is located intermediately of the first and second positions, water may be still be sprayed from some of the spray outlets 64 if at least a portion of the openings 68 fluidly couples a portion of the spray outlets 64. It has also been contemplated that the first valve body 66 may be shaped such that there may be a point where the outlets in the first valve body 66 do not allow for the fluid to enter any of the spray outlets 64 except for the hydraulic drive outlets 108.

The gear chain of the gear assembly 84 is illustrated as forming a reduction gear assembly. That is the first valve body 66 is moved between the two positions by the actuator 80 over multiple rotations of the lower rotatable spray arm 34. As illustrated, the reduction gear assembly may provide a 40:1 gear reduction such that the first valve body 66 will slide to the first and second positions over forty revolutions of the lower rotatable spray arm 34. The gear ratios of the gear assembly 84 may be selected to control the relative movement of the first valve body 66 to the lower rotatable spray arm 34. The gear ratio of the gear assembly 84 is a function of the ratios of gears forming the gear assembly 84. Thus, the gears may be selected to provide a desired ratio to provide a desired fluid coupling time between the liquid passage 62 and the spray outlets 64. The gear reduction ratio may also be selected to aid in allowing the hydraulic drive outlets 108 to overcome the friction created by the first valve body 66. To generate the greatest torque, the drive outlets 108 may be located near the tip of the sprayer body 56, which is the greatest distance from the axis of rotation.

As the lower rotatable spray arm 34 turns, the first valve body 66 continues to move between the first and second positions and continues to selectively fluidly couple some of the spray outlets 64. The amount of time that the multiple openings 68 are fluidly coupled with each of the spray outlets 64 controls the duration of the time that each of the spray outlets 64 spray liquid. The time of fluid coupling may be thought of as a dwell time. With the above described first valve body 66 and actuator 80, the dwell time may be controlled by the gear ratio, the spacing between the two opposing walls 95, 96 extending around the pin 92, and the flow rate of liquid. The movement of the lower rotatable spray arm 34 and the first valve body 66 ends when fluid is no longer pumped by the recirculation pump 46 to the lower rotatable spray arm 34 such that the lower rotatable spray arm 34 is no longer hydraulically driven.

Instead of being hydraulically driven, a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. If the lower rotatable spray arm 34 is motor operated, the first valve body 66 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the spray outlets 64 in pre-selected areas of the treating chamber 20.

Regardless of whether the lower rotatable spray arm 34 is hydraulically driven or not, the second valve body 72 may be moved by the actuator 100 relative to the sprayer body 56 and/or the first valve body 66. In a first position, illustrated in FIGS. 3A and 3B, the second valve body 72 does not interfere with the fluid coupling between the spray outlets 64 and the liquid passage 62. Further, as illustrated, the actuator 100 is uncoupled from the second valve body 72.

Figure 3C:
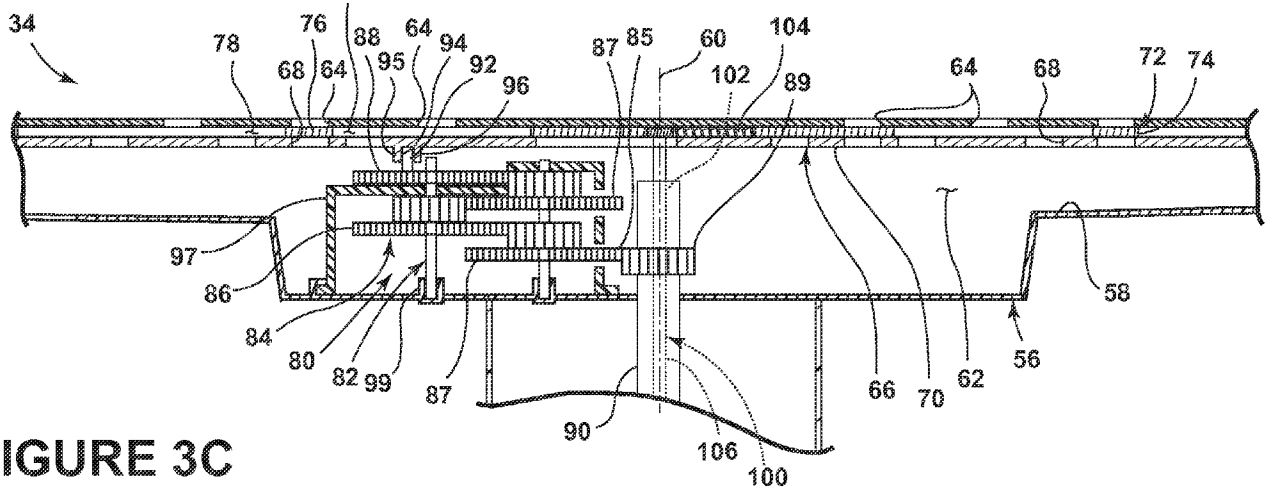

As illustrated in FIG. 3C, the actuator 100 may be operably coupled with the second valve body 72. More specifically the gear 102 may be raised until it engages the teeth 104 formed in the second valve body 72. A driver such as a solenoid (not shown) may be used to rotate the gear 102. As the gear 102 rotates in place around the axis 60, the second valve body 72 may be moved from the first position to the second position illustrated in FIG. 3C. In the second position the second valve body 72 is illustrated as controlling a flow of liquid through some of the multiple spray outlets. More specifically, in the second position, at least one of the solid portions 76 may block the fluid coupling between some of the multiple spray outlets 64 and the liquid passage 62. It has been illustrated that the second valve body 72 has blocked the fluid coupling between the right most spray outlet 64 and the liquid passage 62. In this manner, the second valve body 72 is moveable between a first position (FIGS. 3A and 3B) where the second valve body 72 does not block the fluid coupling between the multiple spray outlets 64 and the liquid passage 62 and a second position (FIG. 3C) where the second valve body blocks the fluid coupling between at least one of the multiple spray outlets 64 and the liquid passage 62.

It is contemplated that the second valve body 72 may be automatically moved based on a selected cycle of operation of the dishwasher 10. More specifically, if the selected cycle calls for greater coverage, then the second valve body 72 may be moved to the first position where the fluid coupling between the multiple spray outlets 64 and the liquid passage 62 is allowed. Conversely if a selected cycle require the use of less water, then the second valve body 72 may be moved to the second position where the fluid coupling between one or more of the multiple spray outlets 64 and the liquid passage 62 is blocked.

Figure 4:
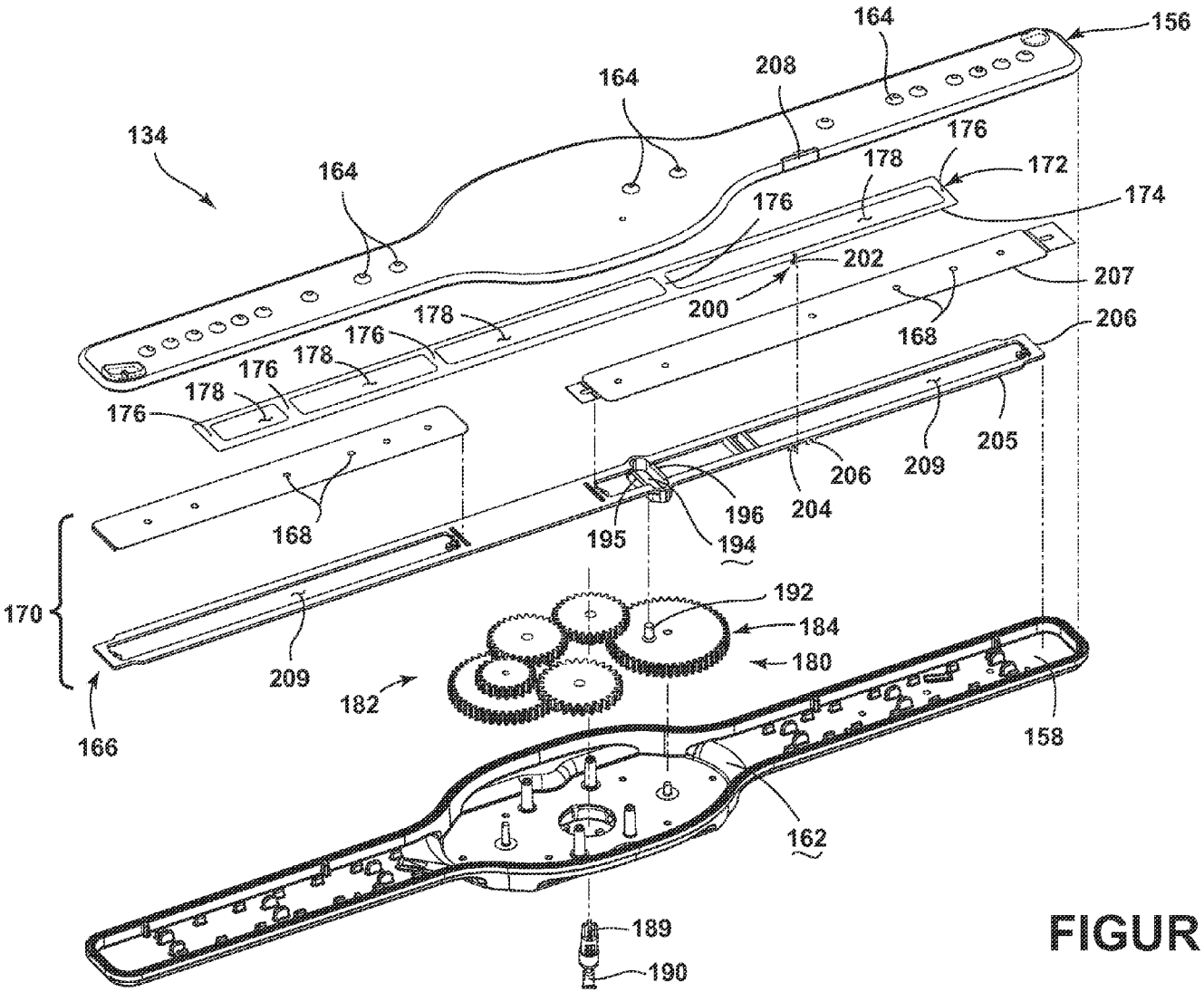
FIG. 4 is an exploded view of a rotatable spray arm according to an embodiment of the invention that may be used in the spray system of the dishwasher of FIG. 1.

FIG. 4 illustrates an exploded view of an alternative lower rotatable spray arm 134 first valve body 166, and a second valve body according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

One difference is that instead of having an actuator for moving the second valve body 172 between positions the first valve body 166 and the second valve body 172 include a coupling mechanism 200 for operably coupling the first valve body 166 to the second valve body 172 such that they may move in tandem. Any suitable coupling mechanism may be used. In the illustrated example, the coupling mechanism 200 includes a projection 202 operably coupled or formed on a portion of the second slidable element 174 and retainers 204 and 206 operably coupled or formed on a portion of the first slidable element 170. The projection 202 may be received in either of the retainers 204 and 206. If the projection 202 is received in the retainer 204, it may be considered to be in a first position and may not block any of the fluid couplings between the spray outlets 164 and the liquid passage 162. If the projection 202 is received in the retainer 206, it may be considered to be in a second position and may block the fluid coupling between at least one of the multiple spray outlets 164 and the liquid passage 162. In the illustrated example, a door 208 may provide access to the coupling mechanisms 200 such that a user may selectively place the projection into one of the retainers 204 and 206.

Another difference is that the first slidable element 170 is illustrated as including a two-piece construction including a frame 205 supporting a membrane 207. The membrane 207 may be supported or operably coupled to the frame 205 in any suitable manner. For example, the membrane 207 may be attached at its ends to allow the membrane 207 to move and conform to the sprayer body 156. The membrane 207 is illustrated as including openings 168 all of which may be in fluid communication with the liquid passage 162. The frame 205 may include open portions 209 to allow liquid to reach the membrane 207 from the liquid passage 162.

Much like the earlier embodiment the second valve body 172 is illustrated as a single element although this need not be the case. The first slidable element 170 and the second slidable element 174 may be formed from any suitable material. For example, first slidable element 170 and second slidable element 174 may be formed from a flexible material such that they may conform to a shape of at least a portion of the sprayer body 156 during use. The material may be able to withstand the high temperatures of the dishwasher 10 and the treating chemistry that is used in dishwasher 10.

It will be understood that any suitable drive assembly may be used to move the first slidable element 174 and the second slidable element 174. For example, a different gear assembly may be used to achieve a higher gear reduction and longer dwell time. Further, sealing rings may be provided along the interior of the sprayer body 256, with one of the sealing rings surrounding each of the spray outlets 264. The sealing ring may create a larger effective outlet and allows for a longer fluid communication between the spray outlets 264 and the liquid passage 262. The sealing ring may be a raised ring surrounding each spray outlet 264 and may take any suitable form including that of an O-ring or other seal. The first slidable element 174 and the second slidable element 174 may be capable of sealing against the sprayer body 256 and/or the sealing rings to better seal the spray outlets 264 against the unintended flow of liquid from the liquid passage 262.

Figure 5A:
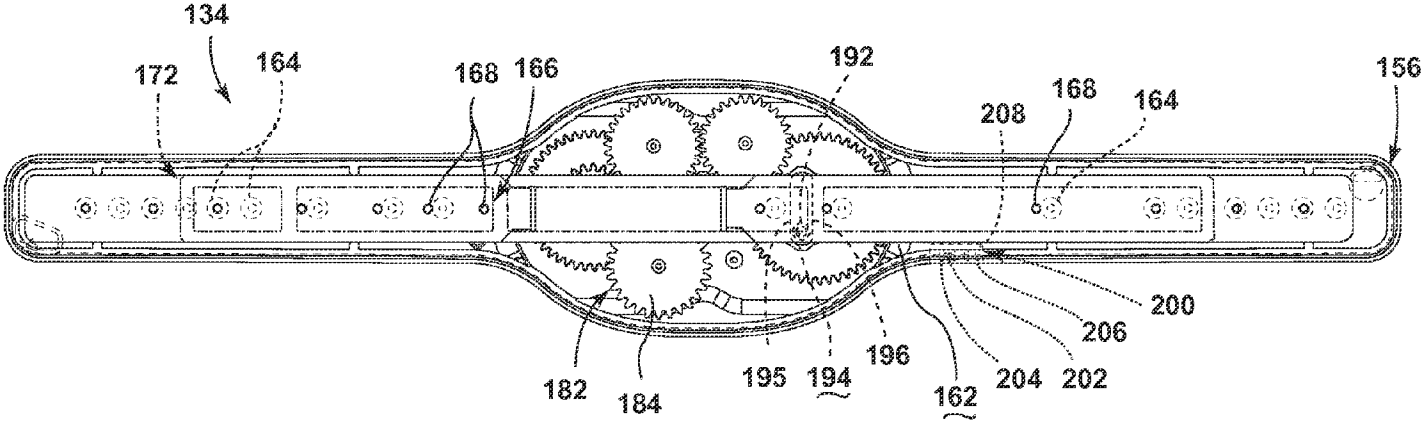
FIGS. 5A-5F are top views of the rotatable spray arm of FIG. 4 and illustrating valve bodies for the rotatable spray arm in various positions.
Figure 5B:
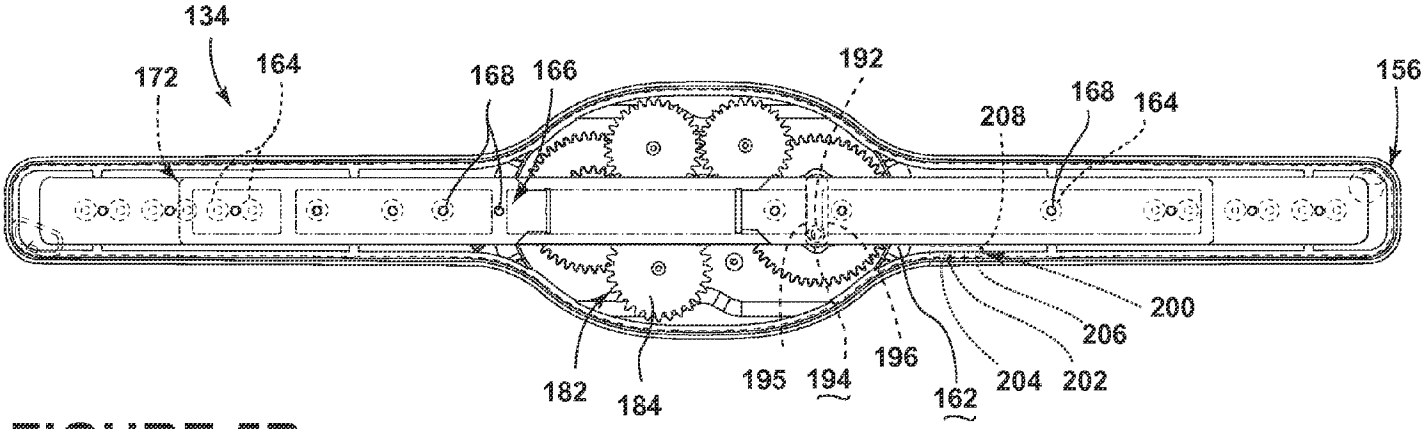
Figure 5C:
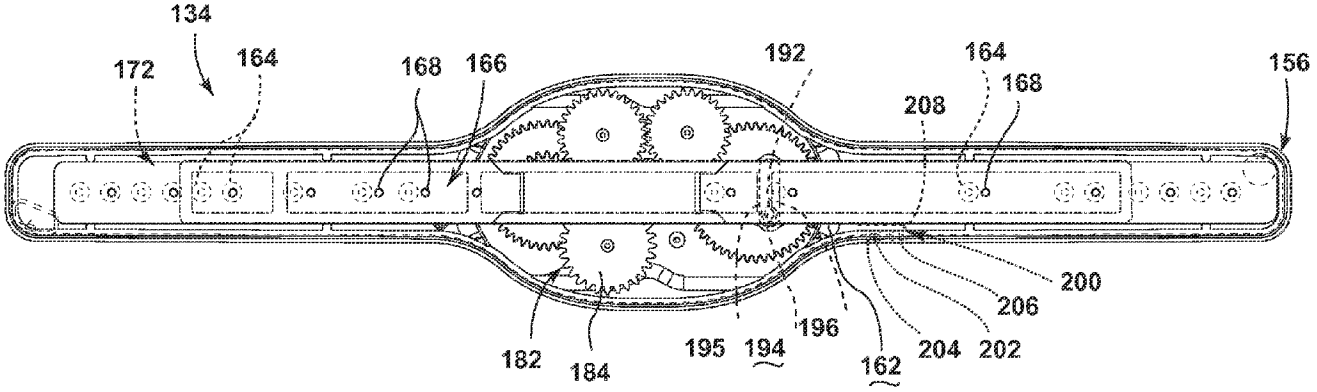

During operation, the lower rotatable spray arm 134, first valve body 166, and second valve body 172, and actuator 180 operate much the same as in the first embodiment wherein as the lower rotatable spray arm 134 is rotated, the gears in the gear assembly 184 are driven and the first valve body 166 is moved. When the first valve body 166 is moved the second valve body 172 is also moved. FIGS. 5A-5C illustrate the first valve body 166 and the second valve body 172 moving from a first position, (FIG. 5A), to an intermediate position (FIG. 5B), and to a second position (FIG. 5C). As illustrated in FIG. 5A, six of the multiple spray outlets 164 are fluidly coupled to the liquid passage 162. In the intermediate position, as illustrated in FIG. 5B, six other multiple spray outlets in the middle of the sprayer body 156 are fluidly coupled to the liquid passage. In the second position, as illustrated in FIG. 5C, six more of the multiple spray outlets 164 are fluidly coupled to the liquid passage 162. Movement between the first and second positions results in emission from three differing sets of six multiple spray outlets 164 at a time. As illustrated the spray emissions from the sprayer body 156 would be an equal ratio. As may further be seen in the illustrations, both valve bodies may be moved based on the rotation of the rotatable sprayer. The second valve body 172 also moves in tandem with the first body 166. In FIGS. 5A-5C, the projection 202 is received in the retainer 204 and the second valve body 172 may be considered to be in a first position where it does not block any of the fluid couplings between the spray outlets 164 and the liquid passage 162. In this position, the second valve body 172 does not block any of the fluid couplings between the spray outlets 164 and the liquid passage regardless of what position the first valve body 166 is in.

Figure 5D:
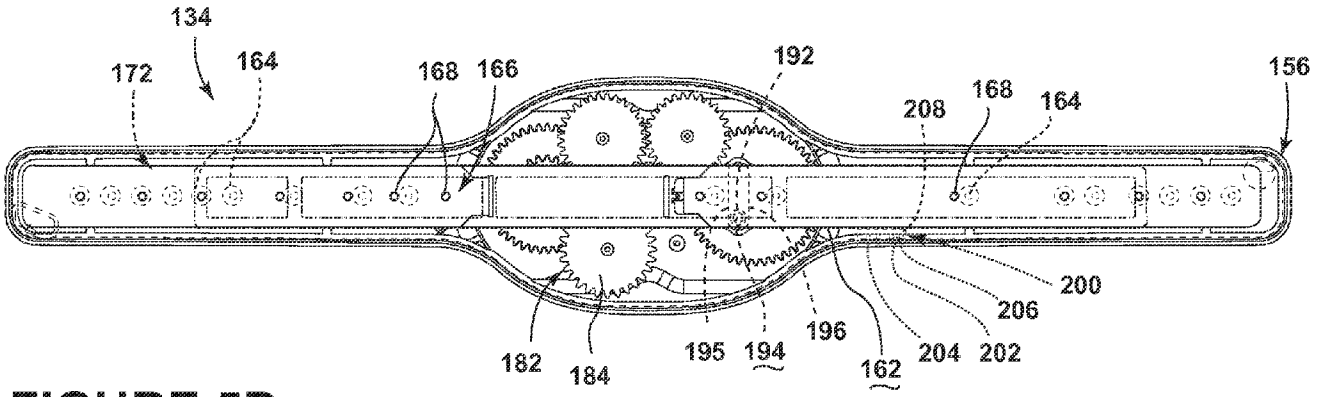
Figure 5E:
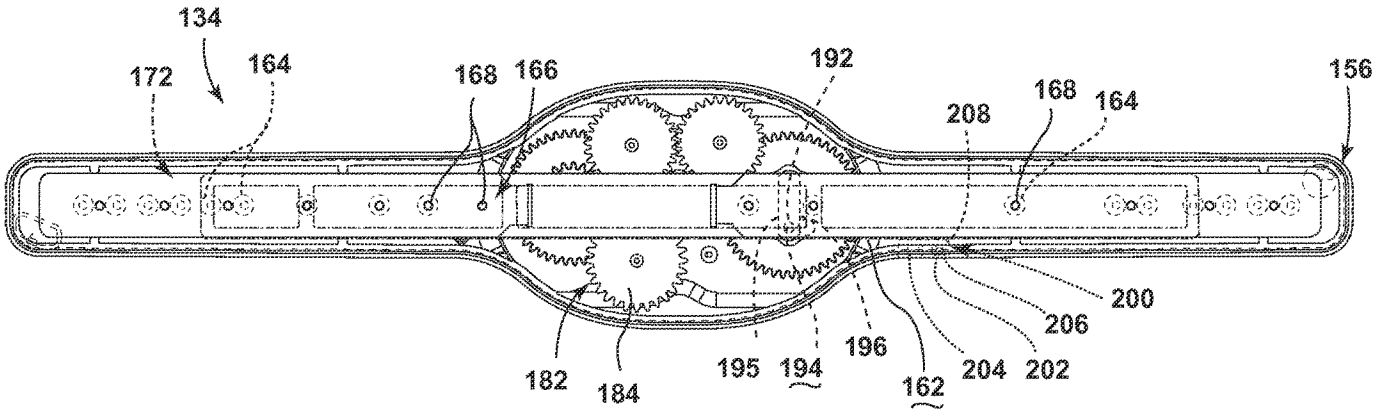
Figure 5F:
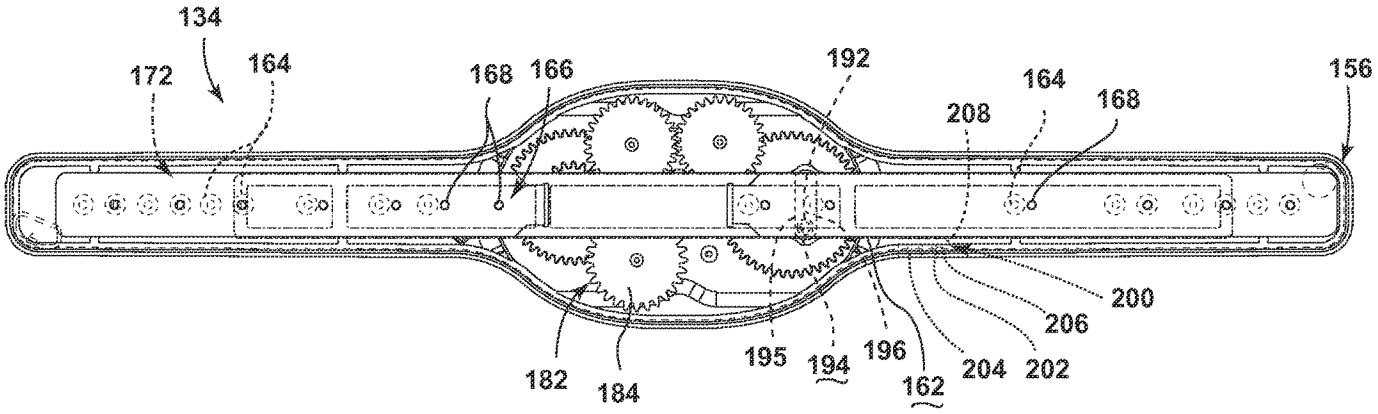

FIGS. 5D-5F also illustrate the first valve body 166 and the second valve body 172 moving from a first position, (FIG. 5D), to an intermediate position (FIG. 5E), and to a second position (FIG. 5F). The difference being that the projection 202 is received in the retainer 206 and the second valve body 172 may be considered to be in a second position where it does block at least one of the fluid couplings between the spray outlets 164 and the liquid passage 162. The position of the first valve body 166 in FIG. 5A is the same as in FIG. 5D, similarly the position of the first valve body 166 in FIG. 5B is the same as in FIG. 5E and the position of the first valve body 166 in FIG. 5C is the same as in FIG. 5F. As illustrated in FIGS. 5D-5F, only four of the multiple spray outlets 164 are fluidly coupled to the liquid passage 162 because the second valve body 172 blocks the flow of liquid to two of the multiple spray outlets 164. In this manner, movement between the first and second positions results in emission from three differing sets of four multiple spray outlets 164 at a time. As illustrated in FIGS. 5D-5F the spray emissions from the sprayer body 156 would be an equal ratio but would be less than the spray emitted in FIGS. 5A-5C. While the second valve body 172 is illustrated as blocking a fluid connection between the same number of spray outlets 164 and the liquid passage 162 regardless of what position the first valve body 166 is in it is contemplated that this may not be the case such that the ratio of spray emitted at each location may not be equal.

Figure 6:
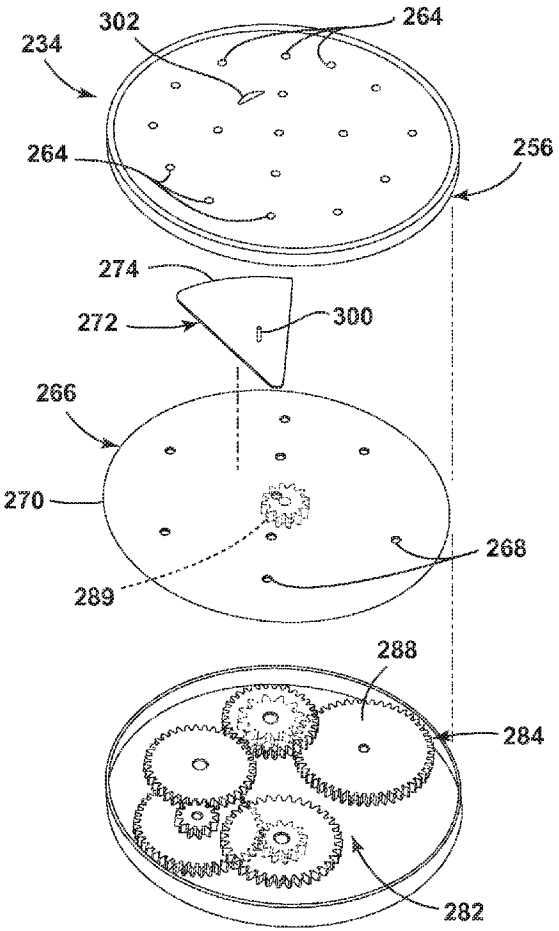
FIG. 6 is an exploded view of another sprayer, which may be used in the dishwasher of FIG. 1.

While the embodiments described and illustrated above are with respect to the lower rotatable spray arm, it will be understood that embodiments of the invention may be used with respect to any rotatable sprayer in the dishwasher. Further, while the valve bodies have been illustrated and described as moving in a linear motion, it is contemplated that the valve bodies may alternatively be moved in any suitable manner including rotational motion or orbital motion. Further, while the sprayer body has been described and illustrated as being in the form of a spray arm it will be understood that any suitable sprayer may be used in any of the above embodiments. For example, the body may include a rotatable disk where the drive outlet relatively rotates the disk and the actuator moves the valve body or valve bodies within the disk to adjust the spray emitted from the disk. FIG. 6 illustrates an alternative sprayer 234 according to a third embodiment of the invention. The sprayer 234 is similar to the spray arm 34 previously described and therefore, like parts will be identified with like numerals increased by 200, with it being understood that the description of the like parts applies to the third embodiment, unless otherwise noted.

One difference is that the sprayer 234 includes a disk shaped sprayer body 256. Further, the first valve body 266 is circular and has multiple openings 268, which are fewer in number than the multiple spray outlets 264. The sprayer body 256 may be stationary or rotatable. If the sprayer body 256 is rotatable it may be either hydraulically or motor driven. The driver or drive system 282 may be configured to rotate the first valve body 266 based on the movement of the sprayer body 256 such that the first valve body 266 rotates within the sprayer body 256 based on the rotation of the sprayer body 256. Alternatively, the drive system 282 may be configured to rotate the first valve body 266 by itself. In the case where the sprayer body 256 is stationary and hydraulic movement does not provide a mechanism for driving the drive system 282 it is contemplated that an input to the drive system 282 may include output from a motor operably coupled to the controller 14. Another difference is that in the illustrated example instead of including a pin that engages the first valve body 266, the gear assembly 284 includes a gear 288, which may be operably coupled to an input gear 289. The input gear 289 may be operably coupled to the first valve body 266 such that the first valve body 266 may be rotated through input to the input gear 289 from the gear 288.

Figure 7A:
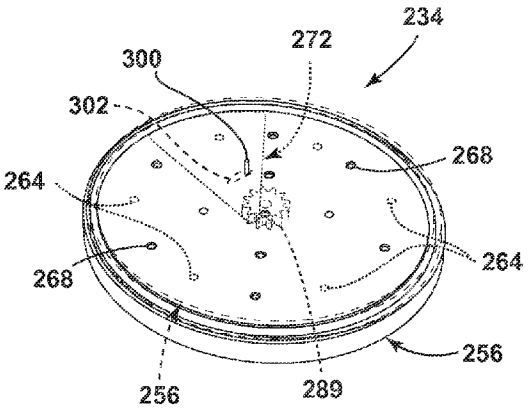
FIGS. 7A-7B are top views of the sprayer of FIG. 6 and illustrating a second valve body in two positions.
Figure 7B:
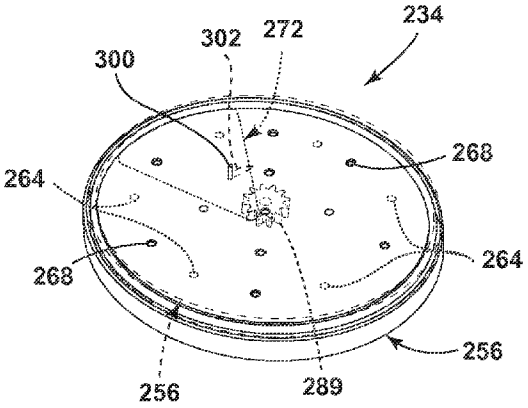

Yet another difference is that the second valve body 272 may be moveable by a user. More specifically, the second valve body 272 includes a pin 300 that may be grasped by a user and moved within a defined opening 302 in the sprayer body 256 such that the location of the second valve body 272 may be moved. FIG. 7A illustrates the second valve body 266 in a first position where the fluid coupling between the multiple spray outlets 264 and the liquid passage 262 is allowed. FIG. 7B illustrates the second valve body 266 in a second position where the fluid coupling between one or more of the multiple spray outlets 264 and the liquid passage 262 may be blocked.

There are several advantages of the present disclosure arising from the various features of the apparatuses described herein. For example, the embodiments described above allow for a sprayer to provide better coverage of the treating chamber without utilizing more water. Further, the sprayer may also be utilized in a water saving mode where some of flow from the sprayer may be restricted while still allowing for good coverage of the treating chamber. This may provide further water savings and energy savings.

While the invention has been specifically described in connection with certain specific embodiments thereof, it is to be understood that this is by way of illustration and not of limitation. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for washing dishes according to an automatic cycle of operation, comprising:

a tub at least partially defining a treating chamber for receiving dishes for cleaning; and a spraying system supplying liquid to the treating chamber and having a sprayer comprising:

a sprayer body mounted within the tub for movement about a rotatable axis and having an interior;

a liquid passage provided in the interior;

multiple spray outlets extending through the sprayer body and in fluid communication with the liquid passage and configured to emit a spray of liquid into the treating chamber to wash the dishes;

a first valve body moveable relative to the sprayer body, the first valve body comprising:

at least one opening to fluidly couple at least one of the multiple spray outlets to the liquid passage;

a first slidable element having a first membrane; and at least one opening in the first membrane that aligns with at least one of the multiple spray outlets; and a second valve body selectively moveable relative to at least one of the sprayer body or the first valve body to control a flow of liquid through the at least one opening or through at least one of the multiple spray outlets.

2. The dishwasher of claim 1 wherein the sprayer body comprises a rotating spray arm.

3. The dishwasher of claim 2 wherein the rotating spray arm and the first valve body are coupled for relative movement.

4. The dishwasher of claim 3 wherein the first valve body and the second valve body are operably coupled and move in tandem.

5. The dishwasher of claim 3 wherein the first valve body reciprocally moves within the sprayer body based on the rotation of the sprayer body.

6. The dishwasher of claim 5 wherein the first valve body comprises multiple opening to fluidly couple multiple spray outlets to the liquid passage.

7. The dishwasher of claim 6 wherein the first valve body is moveable between a first position in which at least some of the multiple spray outlets are coupled to the liquid passage and a second position in which other of the multiple spray outlets are coupled to the liquid passage.

8. The dishwasher of claim 7 wherein the second valve body is moveable between a first position in which the second valve body does not block the fluid coupling between the multiple spray outlets and the liquid passage and a second position in which the second valve body blocks the fluid coupling between at least one of the multiple spray outlets and the liquid passage.

9. The dishwasher of claim 1 wherein the first valve body and the second valve body are located within the sprayer body.

10. The dishwasher of claim 1 wherein the second valve body comprises a second slidable element that has solid portions which may block the fluid coupling between at least one of the multiple spray outlets and the liquid passage.

11. The dishwasher of claim 1 where the second valve body is moveable between a first position where the second valve body does not block the fluid coupling between the multiple spray outlets and the liquid passage and a second position where the second valve body blocks the fluid coupling between at least one of the multiple spray outlets and the liquid passage.

12. The dishwasher of claim 11 wherein the second valve body is manually movable between the first position and the second position.

13. The dishwasher of claim 11 wherein the second valve body is automatically moved based on a selected cycle of operation of the dishwasher.

14. The dishwasher of claim 11 wherein the second valve body is selectively operably coupled to an actuator that is configured to move the second valve body between the first position and the second position.

15. The dishwasher of claim 14 wherein the actuator includes a laterally extendable gear that mates with teeth formed in the second valve body.

16. The dishwasher of claim 15 wherein the actuator further comprises a solenoid operably coupled to the laterally extendable gear and wherein the solenoid may raise, lower, and rotate the laterally extendable gear.

17. The dishwasher of claim 1 wherein the sprayer body comprises a rotating disk.

18. The dishwasher of claim 17 wherein the first valve body rotates within the sprayer body based on the rotation of the sprayer body.

* * * * *